United States Patent [19]

Thomas

[11] Patent Number: 4,593,169

[45] Date of Patent: Jun. 3, 1986

[54] WATER HEATER

[76] Inventor: Perry W. Thomas, 12708 12th St., Grandview, Mo. 64030

[21] Appl. No.: 586,003

[22] Filed: Mar. 5, 1984

[51] Int. Cl.[4] ..... H05B 6/64

[52] U.S. Cl. ..... 219/10.55 R; 219/328

[58] Field of Search ..... 219/10.55 R, 10.55 A, 219/10.55 M, 323, 324, 325, 328, 330

[56] References Cited

U.S. PATENT DOCUMENTS

| | | | |
|---|---|---|---|
| 3,383,495 | 5/1968 | Laube et al. | 219/330 X |
| 4,029,927 | 6/1977 | McMillan | 219/10.55 R |
| 4,165,455 | 8/1979 | Mayfield | 219/10.55 A |

*Primary Examiner*—C. L. Albritton
*Assistant Examiner*—M. M. Lateef
*Attorney, Agent, or Firm*—Kokjer, Kircher, Bradley, Wharton, Bowman & Johnson

[57] ABSTRACT

A water heater in which water is heated by microwave energy. A tank which holds water is separated by a horizontal partition into a relatively small upper chamber and a larger lower chamber. Incoming cold water enters the upper chamber and is heated by a magnetron which produces microwave energy. A transfer conduit accommodates the flow of hot water from the upper chamber to the lower chamber when water is discharged from the lower chamber through an outlet pipe. When the water in the lower chamber cools, a pump returns it to the upper chamber for reheating. The pump and magnetron are controlled by thermostats which maintain the water in the upper and lower chambers at different temperature levels.

17 Claims, 2 Drawing Figures

WATER HEATER

BACKGROUND AND SUMMARY OF THE INVENTION

This invention relates generally to the heating of water and more particularly to a water heater in which microwave energy is used to generate heat.

Conventional domestic water heaters use electric resistant elements or gas or oil burners to heat the water in the tank of the water heater. A substantial part of the heat that is generated is essentially wasted, and this waste of energy has become increasingly undesirable in recent years due to increasing energy costs. Electric resistance heating is rather inefficient, while a significant portion of the heat produced by gas and oil burners escapes through the flue.

It is an important object of my invention to provide a water heating appliance which is more efficient than the water heaters that are currently available for domestic use. Rather than using electric resistance heating or a gas or oil burner, my invention takes full advantage of the efficiency of microwave energy in the heating of water.

Another object of the invention is to provide a water heater having a tank which is partitioned into two separate chambers, one serving as a large capacity holding tank and the other as a heating chamber in which water can be heated to the desired temperature by microwave energy.

A further object of the invention is to provide a water heater of the character described in which water in the holding tank is automatically pumped back into the heating chamber when it has cooled to a temperature level requiring that it be reheated.

An additional object of the invention is to provide a water heater of the character described in which the microwave generator and the pump are accurately and automatically controlled to maintain the water in both chambers at the desired temperature levels.

Still another object of the invention is to provide a water heater of the character described which is constructed in a simple and economical manner and which can be easily installed and serviced.

Other and further objects of the invention, together with the features of novelty appurtenant thereto, will appear in the course of the following description.

DETAILED DESCRIPTION OF THE INVENTION

Figure 1:
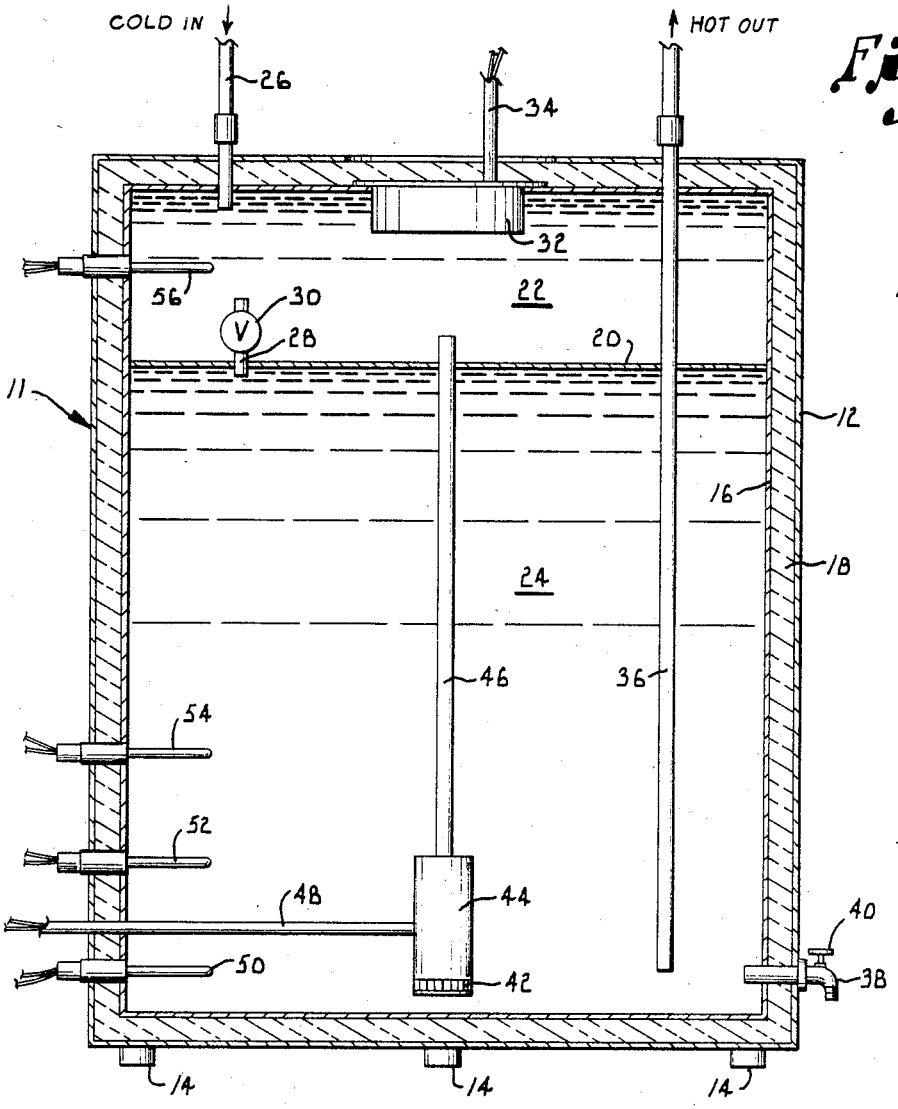
Figure 2:
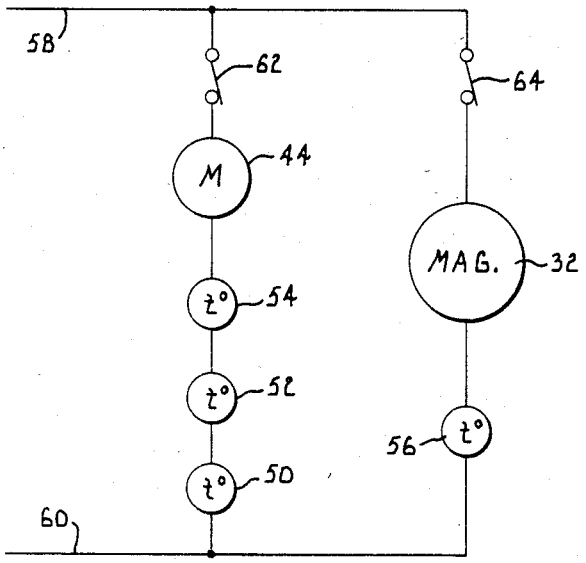

In the accompanying drawing which forms a part of the specification and is to be read in conjunction therewith and in which like reference numerals are used to indicate like parts in the various views:

FIG. 1 is a sectional view taken on a vertical plane through a water heater constructed according to a preferred embodiment of the present invention; and FIG. 2 is a schematic diagram of the electrical control system for the water heater shown in FIG. 1.

Referring now to the drawing in detail, numeral 10 generally designates a water heater constructed in accordance with the present invention. The water heater 10 has a free standing tank 11 which includes an outer shell 12 formed of sheet metal or a similar material. The tank 11 preferably has a cylindrical shape, although it may have a rectangular shape or any other desired configuration. The shell 12 is supported on a plurality of underlying feet 14.

Spaced inwardly from the outer shell 12 is a lining 16 which has substantially the same shape as the shell but a somewhat smaller size. Insulation 18 is interposed between the shell 12 and lining 16. The lining 16 is preferably formed from a material which is resistant to corrosion and which also reflects microwave electromagnetic energy. Alternatively, the lining 16 may be formed from glass which is backed by metal in order to reflect microwaves in the upper portion of the tank, as will be subsequently described.

A horizontal panel 20 forms a partition which divides the interior of the tank 11 into an upper tank or chamber 22 and a lower tank or chamber 24. The upper chamber 22 serves as a heating chamber in which water is heated, and it is considerably smaller than the lower chamber 24 which serves as a holding tank for the heated water.

Preferably, the lower chamber 24 has a capacity 3–5 times that of the upper chamber 22. The panel 20 completely isolates chambers 22 and 24 from one another and is preferably formed of a substance which is resistant to corrosion and yet reflects microwave energy. Alternatively, the partition can be formed by a metal panel sandwiched between a pair of glass or other corrosion resistant panels which are exposed to the water.

A cold water inlet pipe 26 forms an inlet to the upper chamber 22 in order to supply incoming cold water which is to be heated. The cold water pipe 26 is connected with a suitable water supply. The only communication between the upper and lower chambers 22 and 24 is provided by a short vertical conduit 28 which extends through and is secured to the horizontal panel 20. Normally, water is able to flow freely through the transfer pipe 28 from the upper chamber 22 to the lower chamber 24. Pipe 28 is equipped with a valve 30 which is normally open but which can be closed to close the pipe 28.

The water in the upper chamber 22 is heated by electromagnetic microwave energy generated by a magnetron 32. The magnetron is mounted to the lining 16 at the top of chamber 22 and is supplied with electric current by wiring which extends through a suitable conduit 34. The magnetron 32 is conventional and operates to produce microwaves within the upper chamber 22. The microwaves are reflected off of the walls, floors and ceiling of the upper chamber 22 in order to heat the relatively small quantity of water contained therein. The magnetron is equipped with suitable wave guides and related components for directing the microwave energy in all directions so that it is distributed in a substantially uniform manner throughout the upper chamber 22 of the tank. The operating components of the magnetron are suitably shielded from the water.

Water is discharged from the water heater through a hot water outlet pipe 36 having its lower open end located near the bottom of the lower chamber 24. The outlet pipe 36 extends to connection with the hot water distribution system of the building which contains the water heater. Water can also be removed from the lower chamber 24 through a faucet 38 having a hand operated valve 40 which is normally closed.

Water which is to be reheated is transferred from the lower chamber 24 to the upper chamber 22 by a pump 42 having its intake located near the bottom of the lower chamber 24. The pump 42 is driven by an electric motor 44 and pumps water through a vertical riser pipe 46 which extends into the upper chamber 22 in order to discharge the pumped water into the upper chamber. The motor 44 is supplied with electrical current through a conduit 48 which extends through the side of the water heater.

The motor 44 for pump 42 is controlled by three thermostats 50, 52 and 54 each having a temperature sensor located within the lower chamber 24 to sense the water temperature therein. The sensors for the three thermostats are located apart from one another at discrete locations which are vertically separated from one another, as shown in FIG. 1. The magnetron 32 is controlled by a similar thermostat 56 having its temperature sensor located within the upper tank 22 in order to sense the water temperature therein.

FIG. 2 illustrates the manner in which the thermostats control the operation of the pump motor 44 and magnetron 32. A plug (not shown) which can be connected with an ordinary electrical outlet or another power source supplies current to a pair of conductors 58 and 60. The pump motor 44 is connected across lines 58 and 60, and thermostats 50, 52 and 54 are connected in series with one another and with motor 44. Each thermostat 50, 52 and 54 is open when it senses a water temperature above the level set on the thermostat. Each thermostat closes when it senses a water temperature below the thermostat setting. Due to the series arrangement of thermostats 50, 52 and 54, all three thermostats must be closed in order to activate motor 44. Arranged in series with motor 44 and the thermostats 50, 52 and 54 is a normally closed shut off switch 62 which can be opened manually to maintain motor 44 in a deenergized condition.

The magnetron 32 is also connected across lines 58 and 60 and is arranged in series with thermostat 56. Thermostat 56 is open when it senses a water temperature above that set on the thermostat. When the sensed temperature is below the thermostat setting, thermostat 56 closes to thereby activate the magnetron 32. A switch 64 may be arranged in series with magnetron 32 and thermostat 56 to permit the magnetron to be shut off when the switch is manually opened.

In operation, switches 62 and 64 are normally closed and valve 30 is normally open. Both chambers 22 and 24 are filled with water, and the magnetron 32 is energized to produce microwave energy which heats the water in the upper chamber 22. The magnetron 32 remains energized so long as the temperature of the water in the upper chamber 22 remains below the setting of thermostat 56. When the water temperature in chamber 22 is sufficient to satisfy thermostat 56, the thermostat opens to deenergize the magnetron.

When the water temperature in the lower chamber 24 is low enough to close all three thermostats 50, 52 and 54, the pump 44 is energized to pump water from the lower chamber 24 into the upper chamber 22. The incoming water which is discharged into chamber 22 from the riser pipe 46 displaces hot water from the upper chamber which then flows through the transfer pipe 28 into the lower chamber 24. In this fashion, the water heated in chamber 22 by the magnetron is transferred into the lower chamber 24 which serves as a holding tank for the heated water, as previously indicated. Eventually, the temperature of the water in the lower chamber 24 rises sufficiently to satisfy thermostats 50, 52 and 54. When satisfied, each thermostat opens, and the pump motor 44 is then deactivated.

If the water in the holding tank 24 cools sufficiently to close all three thermostats 50, 52 and 54, pump 42 is again activated to pump water into the upper chamber 22 for reheating by the magnetron 32. Ordinarily, the setting of the thermostat 56 in the upper chamber will be well above the settings of the thermostats in the lower chamber 24. Accordingly, the water in chamber 22 is maintained at a considerably higher temperature than the water in the holding tank 24. The use of three thermostats 50, 52 and 54 arranged in series assures that the pump 42 will not cycle excessively but will become active only when the water temperature sensed by all three thermostats is below the thermostat settings. Water that is pumped back into the upper chamber 22 displaces hot water into the lower chamber 24 so that the pumping action results in a raising of the temperature in the lower chamber 24. The magnetron 32 operates to counteract the lowering of the upper chamber temperature that results from the pumping of water from the lower to the upper chamber.

When a hot water tap is opened, hot water flows out of the lower chamber 24 through the hot water outlet pipe 36. The outgoing water is replaced by hot water from the upper chamber 22 which flows through the transfer pipe 28 into the lower chamber. Incoming cold water enters the upper chamber 22 through the cold water inlet pipe 26.

In this manner, water in the holding tank 24 is maintained at the temperature level desired to supply the hot water distribution system, and the water temperature in the upper chamber 22 is maintained at a somewhat higher level so that it is available to quickly heat the lower chamber 24 from which hot water is drawn. The thermostats control pump 42 and magnetron 32 in order to maintain the water at the desired temperature levels in the upper and lower chambers. The provision of three thermostats 50, 52 and 54 at separate, discrete locations within the relatively large holding tank 24 prevent an aborational a "cold spot" at any one location from activating the pump when the prevailing water temperature in the lower chamber is sufficient.

It should be understood that the water heater 10 can be equipped with conventional items such as a sacrificial anode, pressure relief fitting and other devices commonly used in domestic water heaters.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is to be contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A water heater comprising:

a first tank for holding water;

an inlet to said first tank for supplying incoming cold water thereto;

means for applying microwave energy to the water in said first tank to thereby heat the water therein when the temperature of the water in said first tank is below a preselected temperature level;

a second tank adjacent said first tank for holding water;

an outlet for said second tank for discharging heater water therefrom;

conduit means providing communication between said first and second tanks, thereby accommodating flow of hot water from said first tank to said second tank when heated water is discharged from the second tank and incoming cold water enters the first tank through said inlet; and pump means for pumping water from said second tank to said first tank when the temperature of the water in said second tank is below a predetermined temperature level, said preselected level being greater than said predetermined level to maintain the first tank at a higher temperature than the second tank.

2. The invention of claim 1, wherein said first tank is located above said second tank.

3. The invention of claim 1, including:

means for sensing the temperature of the water in said first tank;

means for energizing said applying means when the water temperature sensed by said sensing means is below said preselected level; and means for deenergizing said applying means when the water temperature sensed by said sensing means is above said preselected level.

4. The invention of claim 3, including:

second sensing means for sensing the temperature of the water in said second tank;

means for effecting an active condition of said pump means when the temperature sensed by said second sensing means is below said predetermined level; and means for effecting an inactive condition of said pump means when the temperature sensed by said second sensing means is above said predetermined level.

5. The invention of claim 1, including:

means for sensing the temperature of the water in said second tank at a plurality of discrete locations; and means for activating said pump means to pump water from said second tank to said first tank when the temperature sensed at all of said discrete locations is below said predetermined level.

6. The invention of claim 1, wherein said second tank has a larger capacity than said first tank.

7. A water heater comprising:

an enclosed tank for holding water; a partition in said tank dividing same into an upper chamber and a lower chamber located generally below said upper chamber;

a cold water inlet conduit for said tank communicating with said upper chamber to supply incoming cold water thereto;

means for applying microwave energy to the water in said upper chamber to thereby heat the water therein;

a hot water outlet conduit for said tank communicating with said lower chamber to discharge heated water therefrom;

a transfer conduit extending through said partition to provide communication between said upper and lower chambers, whereby to permit flow of hot water from said upper chamber to said lower chamber when heated water is discharged from the lower chamber through said hot water outlet conduit and incoming cold water enters the upper chamber through said cold water inlet conduit; and pump means for pumping water from said lower chamber to said upper chamber when the temperature of the water in said lower chamber is below a predetermined level.

8. The invention of claim 7, including means for deenergizing said applying means when the temperature of the water in said upper chamber exceeds a preselected level.

9. The invention of claim 7, including:

means for energizing said pump means when the temperature of the water in said lower chamber is below said predetermined level; and means for deenergizing said pump means when the temperature of the water in said lower chamber is above said predetermined level.

10. The invention of claim 7, including:

first sensing means for sensing the temperature of the water in said upper chamber;

means for deenergizing said applying means when the temperature sensed by said first sensing means is above a preselected temperature level;

second sensing means for sensing the temperature of the water in said lower chamber;

said pump means having an active condition and an inactive condition and being operable in the active condition to pump water from said lower chamber to said upper chamber;

means for effecting the active condition of said pump means when the temperature sensed by said second sensing means is below said predetermined temperature level; and means for effecting the inactive condition of said pump means when the temperature sensed by said second sensing means is above said predetermined temperature level.

11. The invention of claim 7, including:

means for sensing the temperature of the water in said lower chamber at a plurality of discrete locations; and means for activating said pump means to pump water from said lower chamber to said upper chamber when the temperature sensed at all of said discrete locations is below said predetermined level.

12. The invention of claim 7, wherein said lower chamber has a greater capacity than said upper chamber.

13. A water heating appliance comprising:

first and second tanks for holding water, said second tank having a larger capacity than said first tank;

a cold water inlet to said first tank for supplying incoming cold water thereto;

means for applying electromagnetic microwave energy to the water in said first tank to heat the water therein when the water temperature in said first tank is below a predetermined level;

a hot water outlet for said second tank for discharging heated water therefrom;

pump means having an active condition and an inactive condition and being operable in the active condition to pump water from said second tank to said first tank;

means for effecting the active condition of said pump means when the temperature of the water in said second tank is below a preselected level less than said predetermined level and for effecting the inactive condition of said pump means when the temperature of the water in said second tank is above said preselected level, whereby heated water in said second tank which cools to a temperature below said preselected level is returned to said first tank for reheating; and conduit means providing communication between said first and second tanks, thereby accommodating flow of hot water from said first tank to said second tank when water enters the first tank through said inlet or through pumping acting by said pump means.

14. The invention of claim 13, wherein said first and second tanks are located in a common enclosure with said first tank disposed above said second tank.

15. The invention of claim 13, including means for deenergizing said applying means when the temperature in said first tank exceeds a predetermined level greater than said preselected level.

16. The invention of claim 13 wherein said effecting means includes:

means for sensing the temperature of the water in said second tank;

means for effecting the active condition of said pump means when the temperature sensed by said sensing means is below said preselected level; and means for effecting the inactive condition of said pump means when the temperature sensed by said sensing means is above said preselected level.

17. The invention of claim 13, wherein said effecting means includes:

means for sensing the temperature of the water in said second tank at a plurality of discrete locations therein;

means for effecting the active condition of said pump means when the temperature sensed at all of said discrete locations is below said preselected level; and means for effecting the inactive condition of said pump means when the temperature sensed at any of said discrete locations is above said preselected level.

* * * * *